US012529531B2

(12) United States Patent
Bell

(10) Patent No.: US 12,529,531 B2
(45) Date of Patent: Jan. 20, 2026

(54) SYSTEMS, METHODS, AND APPARATUSES FOR PASSIVE RADIATIVE COOLING FOR MOBILE AND FIXED ASSETS

(71) Applicant: United Parcel Service of America, Inc., Atlanta, GA (US)

(72) Inventor: Julian Bell, Atlanta, GA (US)

(73) Assignee: United Parcel Service of America, Inc., Atlanta, GA (US)

( * ) Notice: Subject to any disclaimer, the term of this patent is extended or adjusted under 35 U.S.C. 154(b) by 121 days.

(21) Appl. No.: 18/430,199

(22) Filed: Feb. 1, 2024

(65) Prior Publication Data

US 2024/0255236 A1 Aug. 1, 2024

Related U.S. Application Data

(60) Provisional application No. 63/598,766, filed on Nov. 14, 2023, provisional application No. 63/482,598, filed on Feb. 1, 2023.

(51) Int. Cl.
*E21B 23/00* (2006.01)
*F28F 3/12* (2006.01)

(52) U.S. Cl.
CPC ..... *F28F 3/12* (2013.01)

(58) Field of Classification Search
CPC ..... F28F 3/12
USPC ..... 165/121
See application file for complete search history.

(56) References Cited

FOREIGN PATENT DOCUMENTS

| | | | |
|---|---|---|---|
| CN | 1625928 A | * | 6/2005 |
| CN | 2015831800 U | * | 11/2009 |
| TW | M259946 U | * | 7/2004 |

* cited by examiner

*Primary Examiner* — Davis D Hwu
(74) *Attorney, Agent, or Firm* — Shook, Hardy and Bacon L.L.P.; Elena K. McFarland

(57) ABSTRACT

Embodiments of the present disclosure involve providing radiative cooling through various configurations of a heat-dissipating system on which a radiative cooling material may be applied. Particular embodiments involve the use of heat-dissipating panels interlocked to form a heat-dissipating system. Particular embodiments involve the use of a heat transfer element with a heat-dissipating system. Particular embodiments involve the use of a heat-dissipating system to dissipate heat away from an interior space of an object (e.g., vehicle, facility) via a sheet that is applied to or integrated with a top surface (e.g., roofing) of the object. Particular embodiments involve the use of heat-dissipating panels in forming a heat-dissipating system that include front openings allowing airflow to pass through the panels to assist in dissipating heat away from the object.

20 Claims, 6 Drawing Sheets

SYSTEMS, METHODS, AND APPARATUSES FOR PASSIVE RADIATIVE COOLING FOR MOBILE AND FIXED ASSETS

CROSS REFERENCE TO RELATED APPLICATIONS

This application claims priority from U.S. Provisional Patent Application Ser. No. 63/482,598, filed Feb. 1, 2023, and U.S. Provisional Patent Application Ser. No. 63/598,766, filed Nov. 24, 2023, the disclosures of which are hereby incorporated herein by reference in their entirety.

BACKGROUND

Passive radiative cooling features the release of heat from an object or surface in the form of thermal radiation, thereby lowering the temperature of the object or surface or maintaining its temperature at a relatively lower baseline when operating in a steady state. An emerging passive radiative cooling technique involves the use of radiative cooling materials such as paints. These materials prevent substrate heating from solar radiation. Furthermore, radiative cooling materials can passively cool their substrates through various mechanisms, including mid-infrared-spectrum radiation of heat into the void of space. Such materials with this property have been demonstrated over the past few years in the literature, leveraging a variety of chemistries and material compositions to achieve this effect.

SUMMARY

This summary is intended to introduce a selection of concepts in a simplified form that is further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, embodiments that enable and leverage cooling effects provided by radiative cooling materials (e.g., super-white materials, ultra-white materials, etc.) applied to a heat-dissipating system coupled to or integrated into an object. These materials may include, for example, paints, stick-on sheets, and/or the like. For example, the object can be a fixed asset, such as a facility, or a mobile asset, such as a vehicle. In particular embodiments, the heat-dissipating system may be coupled to and/or integrated into a portion of the object. For example, the heat-dissipating system may be integrated into the object and serve as the roof of the object. In addition, the heat-dissipating system may be implemented to provide cooling to an object at very little or no energetic cost (e.g., to passively cool an interior space of a fixed or mobile asset) through the design of the novel heat-dissipating system, among other applications. Further, the heat-dissipating system may be implemented to decrease the temperature of an interior space of an object to improve working conditions and/or prevent heat-related issues in different environments, among other benefits.

In various embodiments, a heat-dissipating panel having a tubular shape is provided. The heat-dissipating panel includes a top face that faces the elements, and a bottom face that is capable of coupling to and/or integrating into an object (e.g., the roof structure of a delivery truck, facility, building, and/or the like). The heat-dissipating panel may be generally rectangular, or may be of any convenient geometry. The heat-dissipating panel also includes a first edge and a second edge. The first edge may include an interlocking component that extends outward from an interior of the heat-dissipating panel. The second edge may include an interlocking component that extends inward into the interior of the heat-dissipating panel. In particular embodiments, such a configuration can allow the interlocking component of a first edge of a first panel to interlock with the interlocking component of a second edge of a second panel upon installation. In some embodiments, the heat-dissipating panel is preferably designed so that it can be produced using cost-efficient panel production methods, such as extrusion, seam welding, and the like.

In particular embodiments, a bottom side of the top face of the heat-dissipating panel includes a heat transfer element having some type of geometry that provides beneficial properties, such as exposed surface area, turbulence generation, and/or the like, to increase the rate of heat transfer from working fluid into the heat-dissipating panel's bulk. In some embodiments, the heat transfer element may be implemented as fins. For example, the heat transfer element may be implemented as rows of linear fins extending from the bottom side of the top face. Additionally, or alternatively, the heat transfer element may be implemented as corrugations. For example, the heat transfer element may be implemented as rows of linear ridges and/or grooves extending from the bottom side of the top face. Additionally, or alternatively, the heat transfer element may be implemented as some type of gyroid pattern, open-cell metal foam, and/or the like extending from the bottom side of the top face, and covering at least a portion of the surface area of the bottom side. Further, in additional or alternative embodiments, a top side of the bottom face includes a heat transfer element with some type of geometry that provides beneficial properties to increase the rate of heat transfer to or from the environment.

In particular embodiments, the panel may be divided internally into two compartments, an upper compartment and a lower compartment. In some embodiments, the compartments may be separated by a feature (e.g., a divider) produced during the construction of the panel (e.g., an extruded feature). Additionally, or alternatively, the compartments may be separated by a second body (e.g., a plastic shim, metallic plate, etc.) installed into the panel after manufacture. For example, the second body, or divider, may be a flat sheet of material with a low coefficient of thermal conductivity. In this manner, the flow of fluid through the panel may be separated into a fluid that contacts the heat transfer element described above and a fluid that is separated from that first body of fluid.

In various embodiments, two or more heat-dissipating panels may be mated together (e.g., interlocked) to form a heat-dissipating system. In addition to forming a heat-dissipating system, the mating mechanism may allow for multiple panels to be interlocked together to adjust the sizing of the heat-dissipating system to accommodate a particular surface area of an object on which the panels are being installed. In certain embodiments, the top face of each of the panels that make up the heat-dissipating system may be coated with a radiative cooling material, such as, for example, paint, stick-on sheet(s), and/or the like, to dissipate heat from the body of the panels, and specifically, from any fluid (e.g., gases, liquid, etc.) flowing inside the panels. Additionally, when mated, in certain embodiments, the interlocking components on the edges of the panels may interlock such that the front face of each panel is flush, covering the interlocking components to make a flat surface area of the heat-dissipating system. This may allow the interlocking components and fasteners used to secure the panels to the object to be hidden when assembled.

In various embodiments, the heat-dissipating system may be coupled to or integrated into an object. For example, the heat-dissipating system may be coupled to or integrated into a top of a vehicle to form the roof of the vehicle, with the system's primary axis disposed along the primary axis of motion of the vehicle. As noted, the top faces (e.g., surfaces) of the heat-dissipating panels that make up the heat-dissipating system may be covered with a radiative cooling material. In this way, while the vehicle is in motion and outdoor air, at ambient temperature, passes through openings of the panels, heat is transferred from the air into the panels, resulting in the air being cooled below ambient temperature. The air may then be ejected into an interior space of the vehicle such as a cabin and/or cargo space of the vehicle.

Various embodiments of the disclosure also provide a heat-dissipating system that is not necessarily constructed of heat-dissipating panels. In these embodiments, the heat-dissipating system may be configured for dissipating heat from an interior space of an object for the purpose of decreasing the temperature of the interior space. In particular embodiments, the heat-dissipating system may serve as an integrated component of the object. For example, the heat-dissipating system may serve as the roof, or portion thereof, to an interior space such as a cargo space and/or cabin space of a vehicle or a roof of a storage space of a facility, with a bottom face of the heat-dissipating system serving as a ceiling, or portion thereof, to the interior space and a top face of the heat-dissipating system facing the elements such as the outside environment. In some embodiments, the top face (e.g., top surface) of the heat-dissipating system is covered with a radiative cooling material to dissipate heat from the system, and specifically, from any fluid (e.g., air) flowing over the surface area of the bottom face of the system.

Similar to the interlocking heat-dissipating panel, the bottom side of the heat-dissipating system in these embodiments may be configured with a heat transfer element having some type of geometry that provides beneficial properties, such as exposed surface area, turbulence generation, and/or the like, to increase the rate of heat transfer from working fluid to the bulk of the heat-dissipating system. In addition, some type of powered component may be used in creating a flow of the fluid (e.g., airflow) over the heat transfer element. For example, a circulating fan, such as a high volume, low speed (HVLS) fan, may be used in moving a high volume of air across the surface area of the bottom side of the heat-dissipating system. As another example, a blower fan, such as a high volume truck cooler (HVTC) fan, may be used in blowing a high volume of air directly across the surface area of the bottom side of the heat-dissipating system.

In particular embodiments, the heat transfer element may be implemented as fins or corrugations. For example, the heat transfer element may be implemented as rows of radial fins, ridges, groves, and/or the like that extend from the bottom side of the heat-dissipating system to accommodate a fluid flow (e.g., an airflow) produced by a power component such as a circulating fan. As another example, the heat transfer element may be implemented as rows of linear fins extending from the bottom side of the heat-dissipating system to accommodate a fluid flow (e.g., an airflow) produced by a power component such as a blower fan. Additionally, or alternatively, the heat transfer element may be implemented as some type of gyroid pattern, open-cell metal foam, and/or the like extending from the bottom side of the heat-dissipating system and covering at least a portion of surface area of the bottom side. In addition to the aforementioned aspects, methods of manufacturing and operating the interlocking heat-dissipating panel and/or heat-dissipating system are also provided herein.

The term "object," as used herein, should be interpreted broadly to include any one or combination of assets, such as a facility or vehicle. For example, in one instance, an object may be a package car used in the delivery of packages to a destination in a logistics network.

The term "logistics network," as used herein, should be interpreted broadly to include any combination of components, systems, technology, and/or persons or locations that operate to transport objects to different destinations.

BRIEF DESCRIPTION OF THE DRAWINGS

The embodiments described herein involve heat-dissipating systems used for purposes of cooling an interior of an object and are described in detail with reference to the attached figures, which illustrate non-limiting examples of the disclosed subject matter, wherein.

Figure 1A:
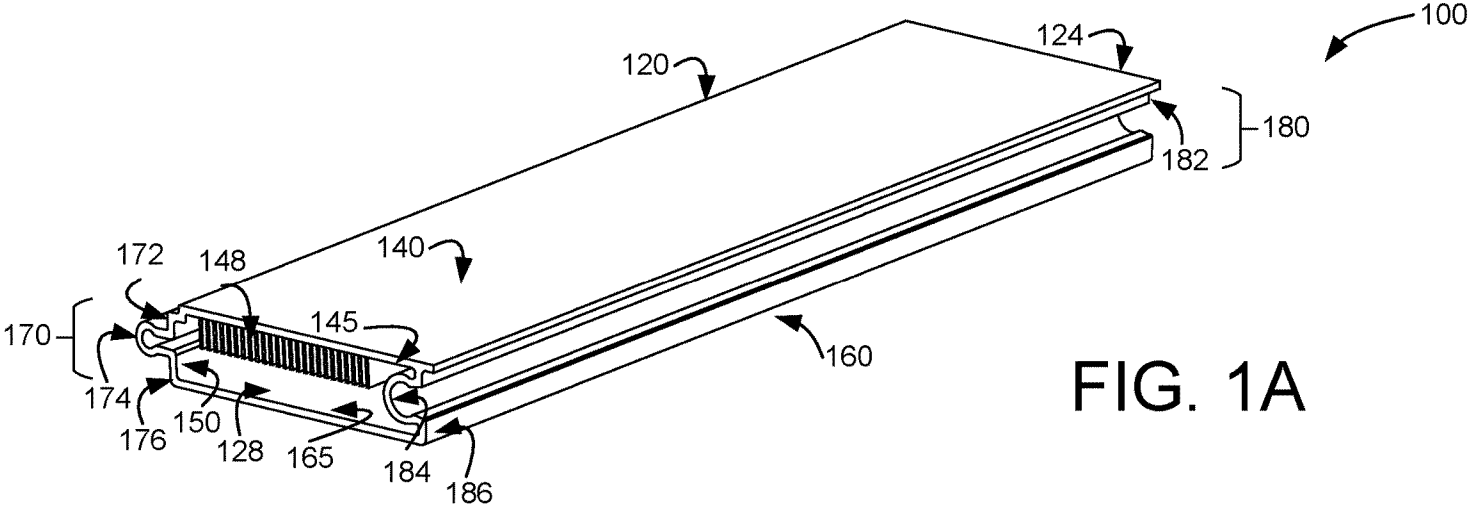
FIGS. 1A and 1B depict an example heat-dissipating panel for supporting the operation of embodiments described herein.

While the present disclosure is amenable to various modifications and alternative forms, specifics thereof have been shown by way of example in the drawings and will be described in detail. It should be understood, however, that the intention is not to limit the particular embodiments described. On the contrary, the intention is to cover all modifications, equivalents, and alternatives falling within the scope of the present disclosure. Like reference numerals are used to designate like parts in the accompanying drawings.

DETAILED DESCRIPTION

Overview

The present disclosure relates to radiative cooling that involves the use of a heat-dissipating system on which a radiative cooling material such as, for example, radiative cooling paint, stick-on sheets, and/or the like is applied. In particular embodiments, heat-dissipating panels are used in forming the heat-dissipating system. The heat-dissipating system may be coupled to an object such as a mobile or fixed object (e.g., vehicle or facility) to cool the interior space of the object. Additionally, or alternatively, the heat-dissipating system may be integrated and serve as a component of the object to cool the interior space of the object. For example, the heat-dissipating system may be integrated into a vehicle such that the system serves as a roof, or portion thereof, of the vehicle. While the present disclosure is not necessarily limited to such applications, various aspects of the disclosure can be appreciated through a discussion of various examples using this context.

Non-climate-controlled facilities/environments can refer to structures or buildings that do not have a system in place for regulating temperature and/or humidity. For example, these types of structures can include warehouses, storage sheds, barns, delivery vehicles (e.g., package cars), and other types of structures typically used for storage or industrial purposes. One of the main challenges with non-climate-controlled facilities/environments is the potential for damage to stored goods due to extreme temperatures or humidity levels. For example, high temperatures can cause electronic components to malfunction, while high humidity levels can lead to the growth of mold and mildew.

Additionally, many operations, such as logistic network operations, frequently require manual work to be performed in non-climate-controlled environments (e.g., package cars, sorting facilities, and/or the like). In some instances, the temperature conditions in these environments can increase to the point where persons can potentially suffer from heat exhaustion and/or other heat-related illnesses. Due to the nature of these environments, traditional cooling techniques (e.g., air conditioning) are not feasible. As such, there is a need for passive cooling techniques that can be applied to these environments to assist in lowering the temperature.

Embodiments of the present disclosure overcome the above, and other problems, by implementing a heat-dissipating system for purposes of cooling an interior of an object. In certain embodiments, the heat-dissipating system is made up of heat-dissipating panels forming a sheet on which a radiative cooling material is applied. For example, the heat-dissipating system may be disposed on the roof of a vehicle and may operate in a non-powered manner in that inlets of the heat-dissipating system can be oriented along the same primary axis as the vehicle's primary axis of motion so as the vehicle moves, the orientation allows air to pass through the heat-dissipating system to cool the interior space of the vehicle.

Additionally, or alternatively, the heat-dissipating system may be integrated into an object for purposes of cooling an interior space of the object. For example, the system may be integrated into the roof of a vehicle, on which a radiative cooling material is applied on a top face of the system. Here, the heat-dissipating system may operate in a powered manner by including some type of powered component (e.g., a fan) to force airflow over a bottom surface of the system to cool the air circulating through the interior space of the vehicle. In these instances, the heat-dissipating system operating in a powered manner may allow for cooling of the interior space of the vehicle while the vehicle is in motion or stopped.

Radiative cooling is the process by which a surface loses heat by emitting thermal radiation. An advantage of radiative cooling is technologies can often employ radiative cooling to passively cool surfaces. However, radiative heat transfer generally requires a very large temperature difference between the surface being transferred to/from the heat source/sink. Consequently, it is generally very challenging to leverage radiative cooling with objects that are at or near ambient temperature because it is often difficult to provide an object at a dramatically lower temperature to radiate to.

Recent advances in radiative cooling have helped to overcome this limitation by focusing on radiating in the mid-infrared (mid-IR) spectrum, which, if the radiating surface has a clear line-of-sight to the sky, enables the radiating surface to use the "cold sink" provided by outer space to radiatively transfer heat. Radiative cooling materials, such as paints, stick-on sheets, and/or the like, are one such technology that contains pigments and other components that are designed to enhance a surface's ability to emit IR radiation, thereby maximizing this heat transfer mode.

Accordingly, various embodiments of the heat-dissipating system involve applying a radiative cooling material (e.g., super-white, ultra-white material) to a top surface of the system. The radiative cooling material may reflect incoming optical-spectrum radiation efficiently to prevent heating of the surface of the system from solar radiation. Furthermore, as previously described above, these materials may radiate in extremes of the optical spectrum (e.g., mid-IR frequencies) to passively cool the surface. The radiative cooling material can provide heat transfer capacities of up to 100 $W/m^2$ with zero power consumption.

In various embodiments, the heat-dissipating system includes a heat transfer element. The heat transfer element may be configured to have some type of geometry that provides beneficial properties, such as exposed surface area, turbulence generation, and/or the like, to increase the rate of heat transfer from working fluid to the bulk of the system. For example, the heat transfer element may be implemented as fins (e.g., rows of linear or radial fins), corrugations (e.g., rows of linear or radial ridges and/or groves), some type of gyroid pattern, open-cell metal foam, and/or the like.

In particular embodiments, the heat transfer element is disposed along a bottom side of top faces of heat-dissipating panels used in forming the heat-dissipating system. For example, the heat transfer element may have a heat transfer geometry shaped as rows of fins extending from the bottom side to increase the heat transfer rate to or from the working fluid inside the panels. The heat-dissipating system may operate in a non-powered manner in which outdoor air at ambient temperature can pass through openings of the bodies of the panels while the object (e.g., vehicle) is in motion. As air is forced over the heat transfer element, the air is cooled by convective transfer of heat to the heat transfer element, which is held below ambient temperature by the radiative cooling material applied to the top surface of the heat-dissipating system formed by the heat-dissipating panels. In this manner, heat is transferred from the air into the panels, resulting in the air being cooled below ambient temperature when it is ejected into the object's interior (e.g., vehicle's cabin and/or cargo area).

In some embodiments, the heat-dissipating system includes airflow openings disposed along a top side of bottom faces of the heat-dissipating panels to facilitate ejecting the cooled air into the interior. These airflow openings force air passing through the openings of the panels into the interior space of the object while the object is in motion. For example, as a vehicle drives, ambient, external air is naturally scooped into the front opening ends of the panels and forced down into the vehicle cargo area through the airflow openings, thereby cooling the vehicle interior. In some embodiments, airflow openings of differing sizes are disposed along the length of the top side of the bottom faces of the heat-dissipating panels. The differing sizes may be oriented in such a way as to ensure that the airflow rate through the openings is equalized and the interior of the object is evenly cooled.

In some embodiments, the panel may be divided internally into two compartments, an upper compartment and a lower compartment. These compartments may be separated by a feature integral to the construction of the panel (for example, an extruded feature), or they may be separated by a second body installed into the panel after manufacture (for example, a flat sheet of material with a low coefficient of thermal conductivity). In this manner, the flow of fluid through the panel may be separated into the fluid that contacts the heat transfer element described previously, and fluid that is separated from that first body of fluid. For example, air may first flow through the upper compartment, where it contacts the heat transfer element and is cooled, and then subsequently through the lower compartment, where the now-cooled air may be ejected into the interior of the object.

Additionally, or alternatively, the heat transfer element may be disposed along the bottom side of the heat-dissipating system itself. For example, the heat-dissipating system may be integrated into the object (e.g., may serve as the roof of the vehicle, or portion thereof) and the heat transfer element may have a heat transfer geometry shaped as rows of corrugations extending along the bottom side of the heat-dissipating system to increase the heat transfer rate to or from air forced across the bottom side of the system. In these instances, the heat-dissipating system may operate in a powered manner in which a powered component such as a fan can force the air externally or within the interior of the object (e.g., the cabin and/or cargo area of the vehicle) to pass over the heat transfer element to cool the air by convective transfer of heat to the heat transfer element, which is held below ambient temperature by the radiative cooling material applied to the top surface of the heat-dissipating system. In this manner, heat is transferred from the air into the system (e.g., roof of the vehicle), resulting in the air being cooled below ambient temperature as the air circulates around the object's interior (e.g., cabin and/or cargo area of the vehicle).

In various embodiments, the heat-dissipating system may operate in a non-powered manner. For example, the heat-dissipating system that comprises panels may be configured to ingest air into the panels as a byproduct of an object's (e.g., a vehicle's) motion, pass the air over a heat transfer element to cool the air, and then eject the air into the interior of the object (e.g., into the cabin and/or cargo space of the vehicle). Additionally, or alternatively, embodiments of the heat-dissipating system may operate in a powered manner. For example, the heat-dissipating system may leverage a powered component, such as a fan, to force airflow over a heat transfer element to effectively cool the air as the air circulates around and/or through the interior of the object. As an illustrative example, the heat-dissipating system may make use of a blower fan to ingest outside air into an interior of a package car and force the air to pass over the heat transfer element to provide cooling while the package car is stationary. As another illustrative example, the heat-dissipating system may make use of a circulating fan to circulate air from inside the package car cabin and/or cargo space and force the air to pass over the heat transfer element to provide cooling while the package car is stationary. In this manner, the air may be cooled to a lower steady-state temperature while still at substantially lower net energy consumption than a conventional air conditioning system.

Thus, the techniques described herein provide various improvements over conventional cooling techniques. For example, embodiments that apply the heat-dissipating system to the roof of an object such as a vehicle may provide more efficient cooling mechanisms over conventional methods for cooling the interior space of the vehicle while the vehicle is in motion, as well as while the vehicle is sitting stationary. Specifically, embodiments of the heat-dissipating system provide for a cooling process that involves passing an airflow over a heat transfer element to transfer heat from the air into the system and cool the air. The cooled air may then be passed and/or circulated in an interior space of the vehicle to cool it down. In addition, in various embodiments, the heat-dissipating system may work in conjunction with a radiative cooling material applied to the top surface of the system to further assist in the cooling process. Furthermore, the heat transfer element may provide additional means for improving heat dissipation from the vehicle and into the surrounding environment. As such, embodiments of the disclosure may provide more-efficient cooling mechanisms for environments over conventional cooling techniques.

This detailed description is provided in order to meet statutory requirements. However, this description is not intended to limit the scope of the disclosure. Rather, the claimed subject matter may be embodied in other ways, including different steps, a different combination of steps, different features, and/or a different combination of features similar to those described in this disclosure and in conjunction with other present or future technologies. Moreover, although the terms "step" and "block" may be used herein to identify different elements of methods employed, the terms should not be interpreted as implying any particular order among or between different elements except when the order is explicitly stated.

In general, described herein are embodiments that enable and support heat dissipation and climate control of interior spaces of objects. For example, embodiments of the present disclosure may be implemented in a logistics network operation to improve the temperatures of interior spaces of objects such as storage facilities, sorting facilities, delivery vehicles, and/or the like of a logistic network operation. Detailed embodiments are described below with references to FIGS. 1-5.

Example Heat-Dissipating Panel

Figure 1B:
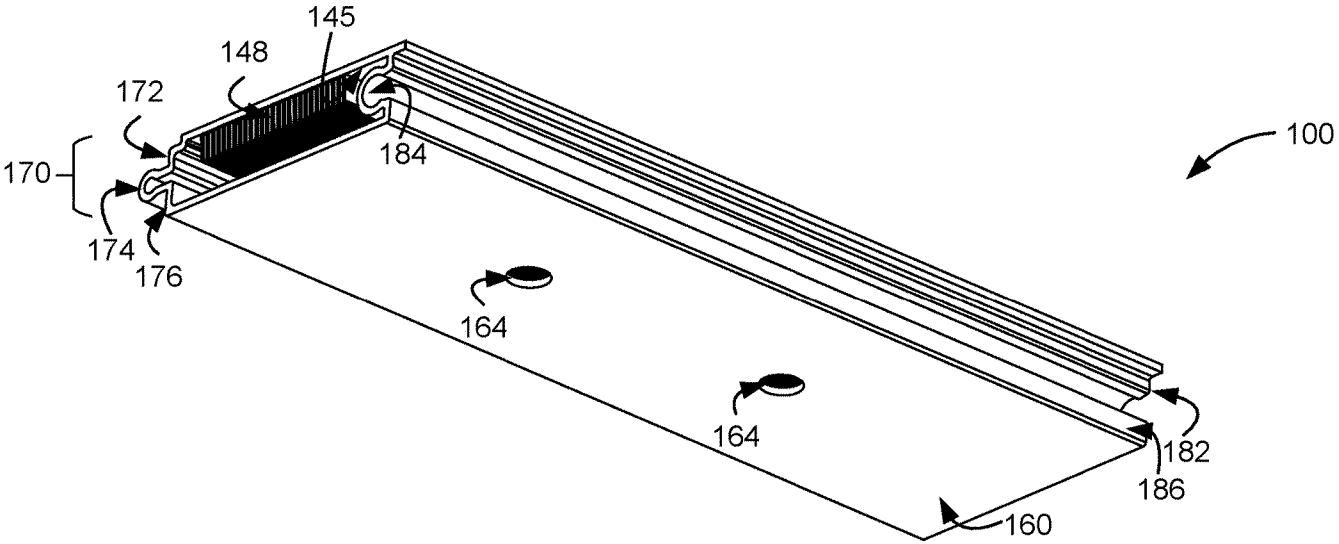

Referring now to FIGS. 1A and 1B, diagrams of an example heat-dissipating panel 100 suitable for use in implementing embodiments of the disclosure are shown. As shown in FIGS. 1A and 1B, the heat-dissipating panel 100 includes a body 120 with a top face 140 having a bottom side 145, interior side walls 150, a bottom face 160 having a top side 165, a first edge 170, and a second edge 180. The heat-dissipating panel 100 in FIGS. 1A and 1B may be made out of various different materials such as copper, aluminum, copper brass, aluminum bronze, iron, thermally conductive plastic, and the like. In various embodiments, the heat-dissipating panels 100 may be composed of materials that have a higher thermal conductivity to allow for better heat dissipation while in operation. However, additionally, or alternatively, the heat-dissipating panel 100 may be made of any material that is capable of providing and forming a rigid sheet and barrier for placement onto an object (e.g., vehicle, facility).

As shown in FIGS. 1A and 1B, the body 120 is in a rectangular panel formation, including a front opening 124 and a rear opening 128. However, the body 120 may take the shape of other panel formations such as a square, a triangular, and/or the like. The top face 140 is the exterior of the panel 100, which faces the elements. In particular embodiments, the bottom face 160 may face the roofing or wall of an object (e.g., vehicle, facility, etc.) or other structure. In some embodiments, the bottom face 160 may be directly exposed to an interior space of an object or other structure.

In various embodiments, the heat-dissipating panel 100 includes features to enable multiple heat-dissipating panels to be interlocked to form a larger rigid sheet. For example, as shown in FIGS. 1A and 1B, the heat-dissipating panel 100 may include a first edge 170 and a second edge 180. The first edge 170 may include a first front edge 172, a first interlocking edge 174, and a first rear edge 176. The first interlocking edge 174 may extend outward from an interior space of the body 120 beyond the first front edge 172 and/or the first rear edge 176. For example, the first interlocking edge 174 may have a body with a cylindrical configuration extending outward from the interior space of the body 120. The second edge 180 may include a second front edge 182, a second interlocking edge 184, and a second rear edge 186. The second interlocking edge 184 may extend inward into an interior space of the body 120 beyond the second front edge 142 and/or the second rear edge 186. For example, the second rounded edge 184 may have a body with a cylindrical configuration extending inward into the interior space of the body 120.

In particular embodiments, the configuration of the first interlocking edge 174 and the second interlocking edge 184 may allow for a first edge 170 of a first heat-dissipating panel 100 to be connected to a second edge 180 of a second heat-dissipating panel 100 when the first heat-dissipating panel 100 is stacked adjacently with the second heat-dissipating panel 100. Here, the first edge 170 of the heat-dissipating panel 100 may be connected to the second edge 180 of the second heat-dissipating panel by interlocking the first interlocking edge 174 of the first heat-dissipating panel 100 with the second interlocking edge 184 of the second heat-dissipating panel 100. Likewise, a first edge 170 of a third heat-dissipating panel may be connected to the second edge 180 of the first heat-dissipating panel in a similar manner. Accordingly, such a configuration may facilitate interlocking multiple heat-dissipating panels to form a heat-dissipating system.

The interlocking features of the first edge 170 and the second edge 180 may be implemented using a variety of techniques and geometries, which can be contemplated by one of ordinary skill in the art in light of this disclosure. For example, instead of the body of the first interlocking edge 174 and the second interlocking edge 184 having a cylindrical configuration, the two edges 174, 184 may have bodies that have a rectangular configuration, a square configuration, an L-shaped configuration, and/or the like so that they may be interlocked to form a larger rigid sheet.

As shown in FIG. 1B, the heat-dissipating panel 100 includes airflow openings 164 in particular embodiments such that external air passing through the front opening 124 and/or the rear opening 128 is forced down through the airflow openings 164 into an interior space of the object (e.g., cargo area of a vehicle) cooling the interior space. In some embodiments, the airflow openings 164 may be manufactured to have different sizes and disposed along the length of the top side 165 of the bottom face 160. For example, the differing sizes may be sized to ensure that the flow rate of air through the airflow openings 164 is equalized and the interior space of the object (e.g., cargo space of vehicle) is cooled evenly. During installation, the airflow openings 164 may be aligned with openings on the surface of the object on which the heat-dissipating system is being installed (e.g., a roof of a vehicle or facility). The alignment may allow for external air that has been cooled by the heat-dissipating system to enter into an interior space of the object through the airflow openings 164.

In particular embodiments, the heat-dissipating panel 100 includes fastener notches. These may be disposed on the top side 165 of the bottom face 160 or in other locations on the body 120. The fastener notches provide placement indicia to indicate where the fasteners should be placed. In some embodiments, when the second edge 180 of the heat-dissipating panel 100 interlocks with a first edge 170 of a second heat-dissipating panel 100, the portion of the top face 140 of the heat-dissipating panel 100 that is over the second edge 180 covers the first edge 170 of the second heat-dissipating panel 100, resulting in a flat top surface area of a heat-dissipating system and providing an area for applying a radiative cooling material while hiding fastener notches. For example, the fastener notch may be routed in a "V" or "U" formation so that the fastener (e.g., screw head) anchors the heat-dissipating panel 100 to the object when installed, thereby allowing the next heat-dissipating panel 100 to interlock without the anchored heat-dissipating panel 100 sliding out of place. Alternatively, the fastener notch may be directly extruded into the panel. For example, the fastener notch may be a channel with internal barbs disposed near the first edge 170 and/or the second edge 180 for screws, or other fasteners, to be installed into.

In various embodiments, the bottom side 145 of the top face 140 includes a heat transfer element 148. The heat transfer element 148 may have some type of geometry that provides beneficial properties, such as exposed surface area, turbulence generation, and/or the like, to increase the rate of heat transfer from the working fluid to the bulk of the panel. As an illustrative example, the heat transfer element 148 may be implemented as fins with a folded-fin style or bonded-fin style heat exchanging geometry extending from the bottom side 145 of the top face 140. In another illustrative example, the heat transfer element 148 may be implemented as corrugations with a geometry composed of rows of linear ridges and/or groves extending from the bottom side 145 of the top face 140. Yet, in another illustrative example, the heat transfer element 148 may be implemented as some type of gyroid pattern, open-cell metal foam, and/or the like extending from the bottom side 145 of the top face 140 and covering at least a portion of the surface area of the bottom side 145.

In some embodiments, the heat-dissipating panel 100 and the heat transfer element 148 are one piece. For example, the heat-dissipating panel 100 may be formed through extrusion or cut such that the entire heat-dissipating panel 100 and the heat transfer element 148 are formed from the same piece of material. In other embodiments, the heat transfer element 148 is formed separately from the heat-dissipating panel 100, and the two are later conjoined. For example, the heat transfer element 148 may be mounted to the bottom side 145 of the top face 140. In another example, the heat-dissipating panel 100 may be formed with an open top face, and the heat transfer element 148 may be attached to the heat-dissipating panel 100 to form this top face.

As shown in FIGS. 1A and 1B, the heat transfer element 148 in various embodiments is disposed on the bottom side 145 of the top face 140 and serves to diffuse heat laterally across the heat-dissipating panel 100 and away from hot spots (e.g., the vehicle, the facility, etc.). The heat transfer element 148 may be formed from any suitable thermally conductive material, such as copper, aluminum, or thermally conductive plastic. In some embodiments, the heat transfer element 148 may include one or more heat pipes and/or vapor chambers configured to transfer heat laterally via evaporative cooling. Additionally, or alternatively, the heat transfer element 148 may be disposed on the top side 165 of the bottom face 160 with a heat exchange geometry such as rows of fins extending from the top side 165 vertically toward the bottom side 145 of the top face 140.

Figure 1C:
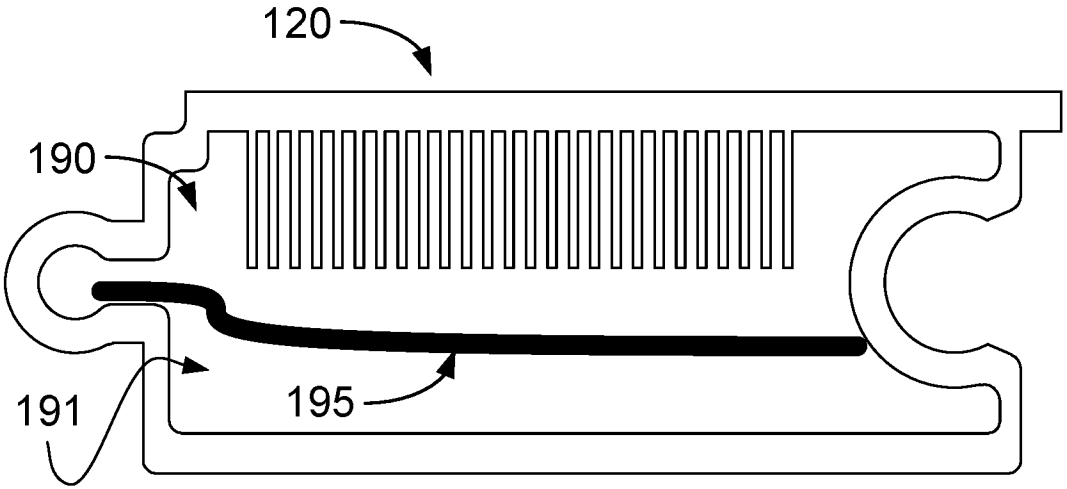
FIG. 1C depicts a body of an example heat-dissipating panel for supporting the operation of embodiments described herein.

In particular embodiments, the body 120 of the heat-dissipating panel 100 is divided into an upper compartment 190 and a lower compartment 191 via a divider 195, as shown in FIG. 1C. In some embodiments, the heat-dissipating panel 100 and the divider 195 are one piece. For example, during extrusion, the heat-dissipating panel 100 may be formed or cut such that the divider 195 is formed from the same piece of material. In other embodiments, the divider 195 is formed separately from the heat-dissipating panel 100 and may be mounted to tracks cut along the interior side walls 150. For example, the tracks may be manufactured along the interior side walls 150 such that the divider 195 (e.g., a plastic shim) can be placed through the tracks creating the upper compartment 190 and the lower compartment 191 within the body 120 of the heat-dissipating panel 100.

In various embodiments, the upper compartment 190 includes an opening that forms the front opening 124 of the body 120 of the heat-dissipating panel 100, so as to allow for ambient air to pass into the panel 100 as described above. In some embodiments, the lower compartment 191 of the heat-dissipating panel 100 is sealed at the front opening 124. Further, in some embodiments, a duct (not shown) may be placed at the rear opening 128 of the heat-dissipating panel 100. The duct may connect the upper compartment 190 to the lower compartment 191 so that air flows from the upper compartment 190 into the lower compartment 191 via the duct. Additionally, or alternatively, the air may flow directly into an interior space of the vehicle from the duct. In this manner, the air flowing into the heat-dissipating panel 100 may be cooled to a greater degree due to the air flowing into the vehicle receiving the same amount of exposure to the heat transfer element 148 of the heat-dissipating panel 100.

In particular embodiments, the front opening 124 of the body 120 is connected to an air transfer system (e.g., a fan, a blower fan, turbine). Here, the air transfer system may be coupled to an object such that air is transferred from an interior space of the object and forced through the front opening 124 of the heat-dissipating panel 100. For example, the heat-dissipating panel 100 may include a divider 195 creating the upper compartment 190 and lower compartment 191 with the air transfer system attaching to the front opening 124 of the upper compartment 190. The air may circulate from the interior space, into the upper compartment 190, through the lower compartment 191, via a connecting duct, and back into the interior space through the airflow openings 164. In this way, the heat-dissipating panel 100 may continuously cool the same volume of air, allowing the object's interior (e.g., vehicle cargo area) to reach lower temperatures than interior spaces without the heat-dissipating system installed.

Example Heat-Dissipating System

Figure 2:
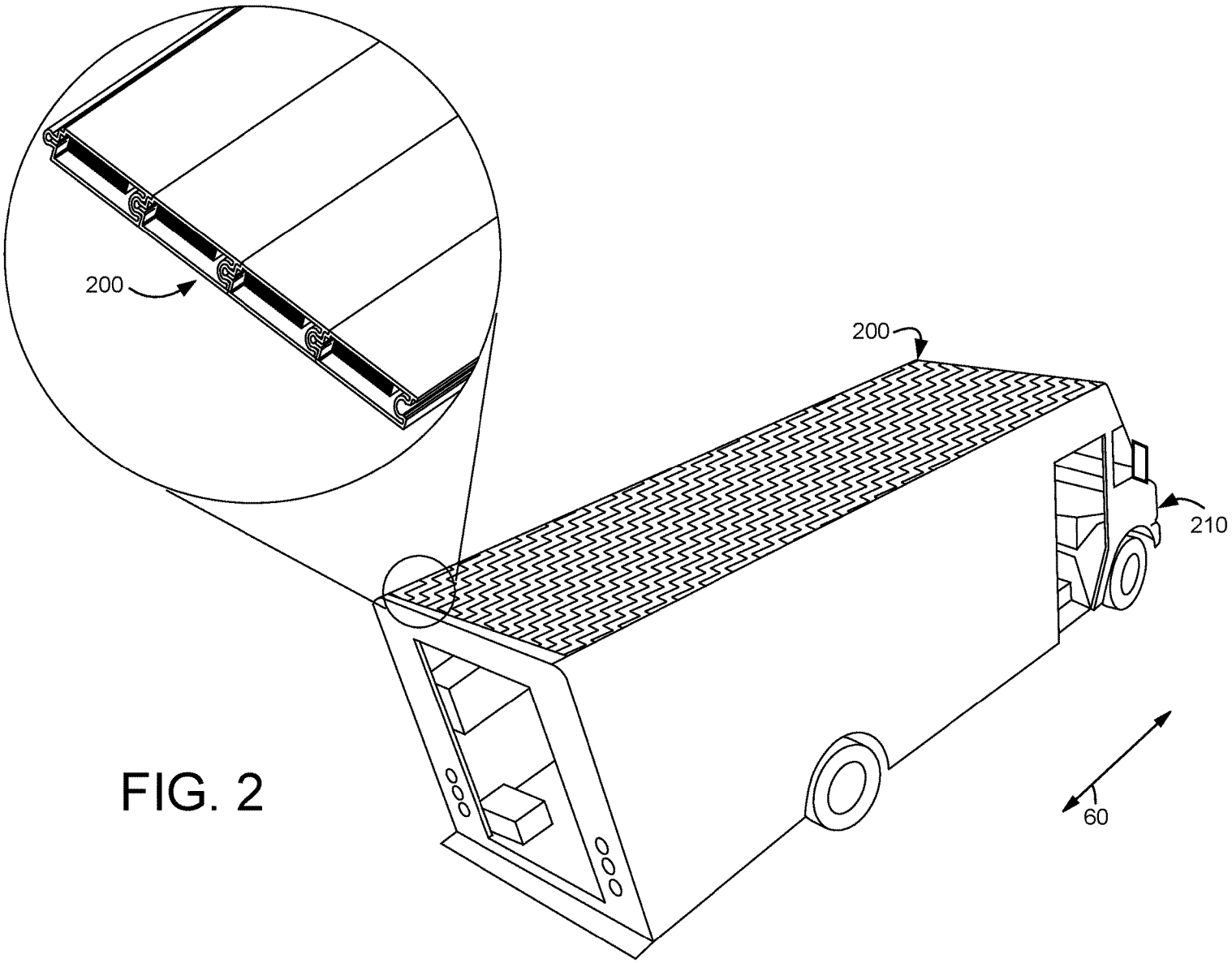
FIG. 2 depicts an example heat-dissipating system for supporting the operation of embodiments described herein.

Referring now to FIG. 2, a diagram of an example heat-dissipating system 200 utilizing heat-dissipating panels that is suitable for implementing embodiments of the disclosure is shown. Here, the heat-dissipating system 200 is coupled to a vehicle 210. As shown, the heat-dissipating panels (e.g., the heat-dissipating panel 100 of FIGS. 1A and 1B) are assembled in an arrangement of interlocking rows that are applied to the roof of the vehicle 210 with their primary axis 60 disposed along the primary axis 60 of a motion of the vehicle 210. In this way, air may pass through openings of the bodies of the panels while the vehicle 210 is in motion, thereby transferring heat from the panels into the environment. As noted, in some embodiments, the top face of each of the heat-dissipating panels that make up the heat-dissipating system 200 is covered with a radiative cooling material (e.g., super-white paint, stick-on sheet(s), and/or the like) to reflect incoming optical-spectrum radiation efficiently and prevent heating of the surface of the system 200 from solar radiation.

Example Flow Diagram

Figure 3:
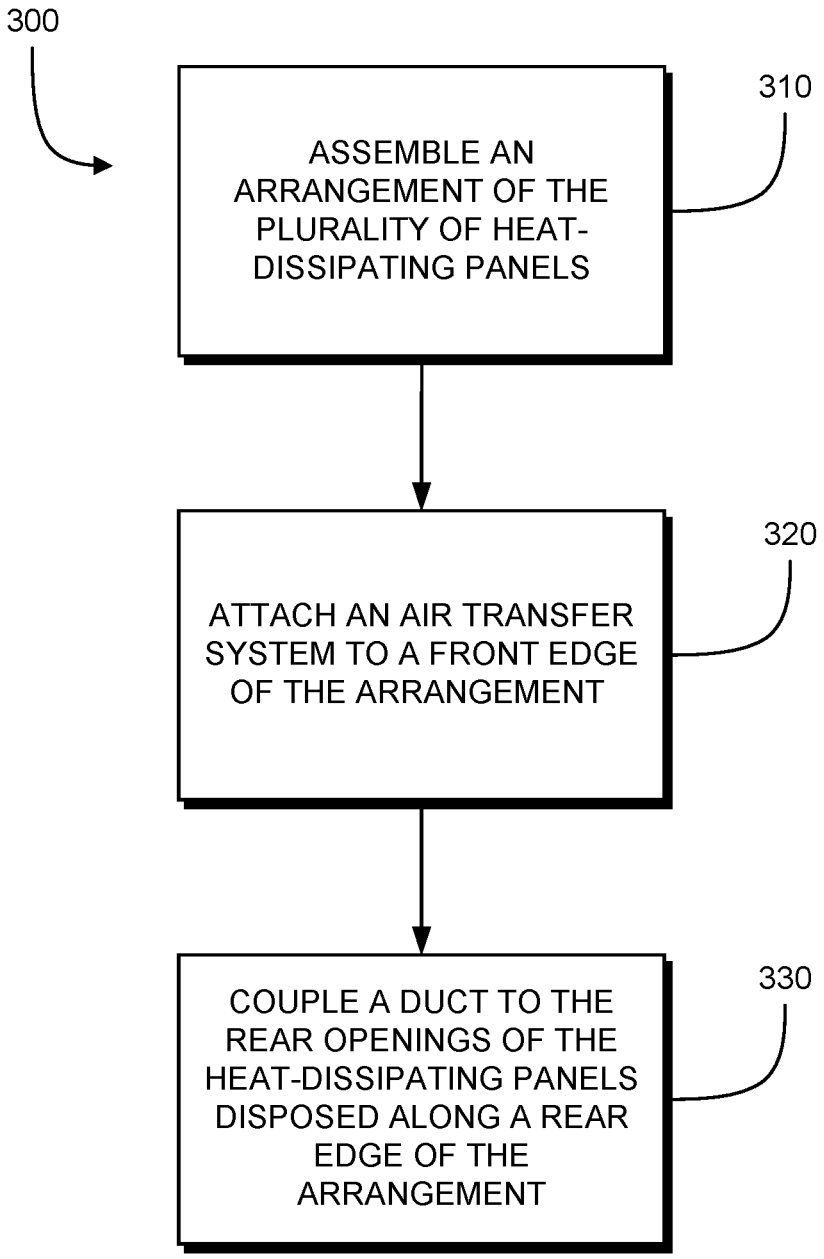
FIG. 3 depicts a block diagram of a method of installing a heat-dissipating system onto an object in accordance with embodiments of the present disclosure.

Looking at FIG. 3, a block diagram of a method 300 for installing a heat-dissipating system onto an object (e.g., vehicle, facility) according to various embodiments of the disclosure is provided. The method 300 includes blocks 310-330, but is not limited to this combination of elements or the order depicted. Here, the method involves installing a plurality of heat-dissipating panels (such as the heat-dissipating panels 100 shown in FIGS. 1A and 1B) to form the heat-dissipating system. However, it should be noted that in some instances a single heat-dissipating panel may be used in forming the heat-dissipating system.

In block 310, the method 300 involves assembling an arrangement of the plurality of heat-dissipating panels to cover a surface area of the object. In various embodiments, block 310 of the method 300 may involve generating rows of heat-dissipating panels by interlocking a succeeding row of the rows with a preceding row of the rows by coupling the first edge of each heat-dissipating panel of the succeeding row with the second edge of a heat-dissipating panel of the preceding row. For example, block 310 may be performed by initially mounting heat-dissipating panels along a first side of the object to begin a first row for the arrangement. Here, mounting the heat-dissipating panels for the first row may involve mounting the panels by nailing, screwing, gluing, or otherwise securing the heat-dissipating panels to the first side of the object. For example, mounting the heat-dissipating panels for the first row may involve placing mounting equipment (e.g., screws) in the fastener notches as indicated on the heat-dissipating panels and placing the heat-dissipating panels along the first side of the object in this manner until a desired length of the first row is achieved such as when the heat-dissipating panels for the first row span the entire length of the first side.

Assembling the arrangement of the plurality of heat-dissipating panels may continue with interlocking a second row of heat-dissipating panels to the first row of heat-dissipating panels disposed along the first edge of the object. In various embodiments, interlocking the panels may be performed by sliding the first interlocking edge of the first edge of each heat-dissipating panel that makes up the second row into the second interlocking edge of the second edge of a heat-dissipating panel that makes up the first row. In addition, airflow openings found in the heat-dissipating panels that make up the row may be aligned with openings on the surface of the object. In this way, during operation, airflow can pass through the airflow openings and into the interior space of the object. Accordingly, block 310 is continued to be performed in a similar manner with interlocking a succeeding row that makes up the arrangement with a preceding row that makes up the arrangement by coupling the first edge of each heat-dissipating panel of the succeeding row with the second edge of a heat-dissipating panel of the preceding row until the surface area of the object is covered.

As previously noted, each of the heat-dissipating panels may have a radiative cooling material applied to the top face of the heat-dissipating panel. The material may prevent substrate heating by optical radiation and may passively cool the substrate through a combination of optical-spectrum reflection and/or radiation. For example, the radiative cooling material may include a "super-white" paint and/or stick-on sheets that is typically made with titanium dioxide that reflects certain wavelengths of sunlight, such as visible light and near-infrared wavelengths, but absorb ultraviolet rays, causing surface heating. Depending on the circumstances, the method 300 for installing the heat-dissipating system onto the object may involve applying the radiative cooling material to each of the heat-dissipating panels prior to installation or applying the radiative cooling material after the arrangement of the plurality of heat-dissipating panels for the system have been fully or partially assembled.

In some embodiments, the method 300 may involve attaching an air transfer system (e.g., fan, a blower fan, turbine, and/or the like) to a front edge of the arrangement that makes up the heat-dissipating system in block 320. For example, the transfer system may be attached to enable producing an airflow, via the air transfer system, that can pass through the front openings of the heat-dissipating panels disposed along the front edge of the arrangement, through the heat-dissipating system, and back into the interior space.

In block 330, the method 300 involves coupling a duct to the rear openings of the heat-dissipating panels disposed along a rear edge of the arrangement. As noted, in particular embodiments, each of the heat-dissipating panels may include a divider that produces an upper and lower compartment for the panel. Here, the duct may be coupled to the rear openings to allow airflow produced by the air transfer system to pass through the upper compartments into the lower compartments via the duct. In some embodiments, block 330 involves coupling the duct with the rear openings and an inlet into the interior space of the object to allow the airflow to pass from the heat-dissipating panels, through the duct, and into the interior space of the object.

Second Example Heat-Dissipating System

Figure 4:
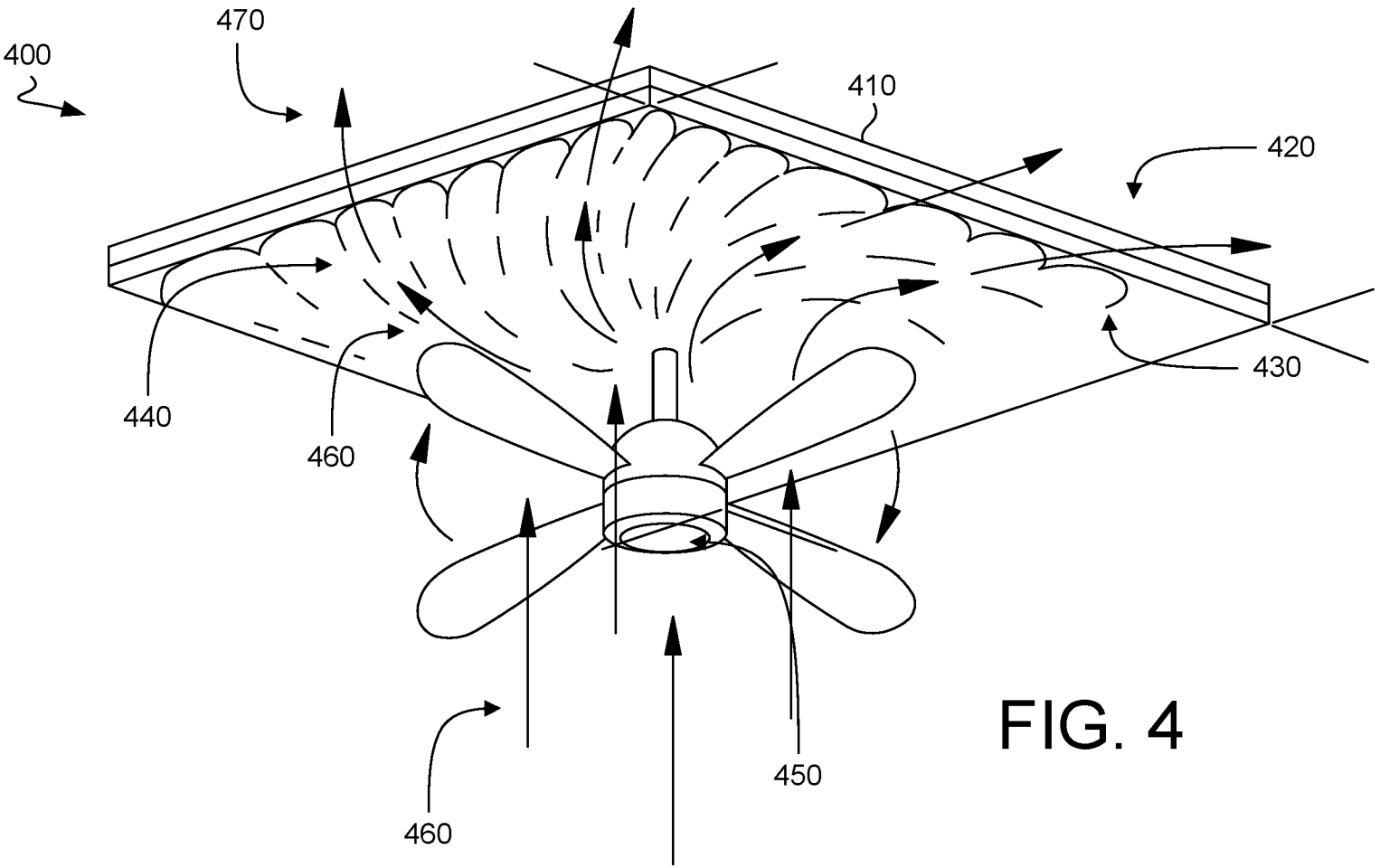
FIG. 4 depicts a second example heat-dissipating system for supporting the operation of embodiments described herein.

Referring now to FIG. 4, a diagram of a second example heat-dissipating system 400 suitable for use in implementing embodiments of the disclosure is shown. As shown in FIG. 4, the heat-dissipating system 400 includes a sheet 410 with a top face 420 and a bottom face 430. As previously discussed, the heat-dissipating system 400 may be configured for integration into an object. For example, the sheet 410 of the heat-dissipating system 400 may serve as a component of the object such as a roof of a vehicle or facility, or portion thereof.

Accordingly, the sheet 410 may be one continuous body in serving as the component of the object or may be combined with sheets 410 of other heat-dissipating systems 400 or other structures to serve as the component of the object. For example, the sheet 410 may be one continuous body that serves as the roof to a vehicle. As another example, the sheet 410 may be combined with other sheets 410 and/or other structures, such as panels, to form the roof of a warehouse facility.

The sheet 410 may be made of different materials such as copper, aluminum, copper brass, aluminum bronze, iron, thermally conductive plastic, and/or the like. In particular embodiments, the sheet 410 may be composed of materials that have a higher thermal conductivity to allow for better heat dissipation while in operation. However, in other embodiments, the sheet 410 may be composed of any material that is capable of providing and forming a barrier for integration with an object (e.g., vehicle, facility, etc.).

As shown in FIG. 4, the sheet 410 is in a square panel formation. However, alternatively, the sheet 410 may take the shape of other panel formations (e.g., rectangular, triangular, etc.). In instances where the sheet 410 serves as a roof of an object, or portion thereof, the top face 420 is the exterior of the sheet 410 that faces the elements, and the bottom face 430 is the interior of the sheet 410 that is directly exposed to an interior space of the object. In addition, the top face 420 of the sheet 410 may provide a surface area for applying a radiative cooling material.

In some embodiments, the bottom face 430 of the sheet 410 includes a heat transfer element 440. The heat transfer element 440 may have some type of geometry that provides beneficial properties, such as exposed surface area, turbulence generation, and/or the like, to increase the rate of heat transfer to or from the environment. As an illustrative example, the heat transfer element 440 may be implemented as fins extending from the bottom face 430 of the sheet 410 such as a folded-fin style or bonded-fin style heat exchanging geometry. As another illustrative example, the heat transfer element 440 may be implemented as corrugations such as a geometry composed of rows of linear ridges and/or groves extending from the bottom face 430 of the sheet 410. Yet, as another illustrative example, the heat transfer element 440 may be implemented as some type of gyroid pattern, open-cell metal foam, and/or the like extending from the bottom face 430 of the sheet 410 and covering at least a portion of the surface area of the bottom face 430.

The heat-dissipating system 400 shown in FIG. 4 includes a powered component 450 for drawing (e.g., forcing) airflow 460 externally or internally sourced from the interior space of the object over the heat transfer element 440. Accordingly, the configuration of the heat transfer element 440 may be provided so as to facilitate the airflow 460 over the heat transfer element 440 and/or facilitate the channeling of the airflow 460 into the interior space of the object. For example, the powered component 450 may be a circulating fan and the heat transfer element 440 may be provided as rows of radial fins or corrugations so as to facilitate efficient airflow 460 over the heat transfer element 440 and into the interior space of the object. Such a configuration can provide the advantage of cooling the airflow generated by the fan inside the interior space of the object. Additionally, or alternatively, such a configuration can provide the advantage of cooling an airflow that is normal to the sheet 410.

In some embodiments, the sheet 410 and the heat transfer element 440 are one piece. For example, the sheet 410 may be formed through stamping, extrusion, forging, injection molding, or cut such that the entire sheet 410 and the heat transfer element 440 are formed from the same piece of material. In other embodiments, the heat transfer element 440 is formed separately from the sheet 410, and the two are later conjoined. For example, the heat transfer element 440 may be mounted to the bottom face 430 of the sheet 410.

Accordingly, as the powered component 450 draws airflow 460 over the heat transfer element 440, the heat transfer element 440 serves to diffuse heat laterally across the sheet 410 and away from hot spots (e.g., vehicle, facility). The cooled air 470 may then circulate within the interior space of the object. The heat transfer element 440 may be formed from any suitable thermally conductive material, such as copper, aluminum, or thermally conductive plastic. In some embodiments, the heat transfer element 440 may include one or more heat pipes and/or vapor chambers configured to transfer heat laterally via evaporative cooling.

Third Example Heat-Dissipating System

Figure 5:
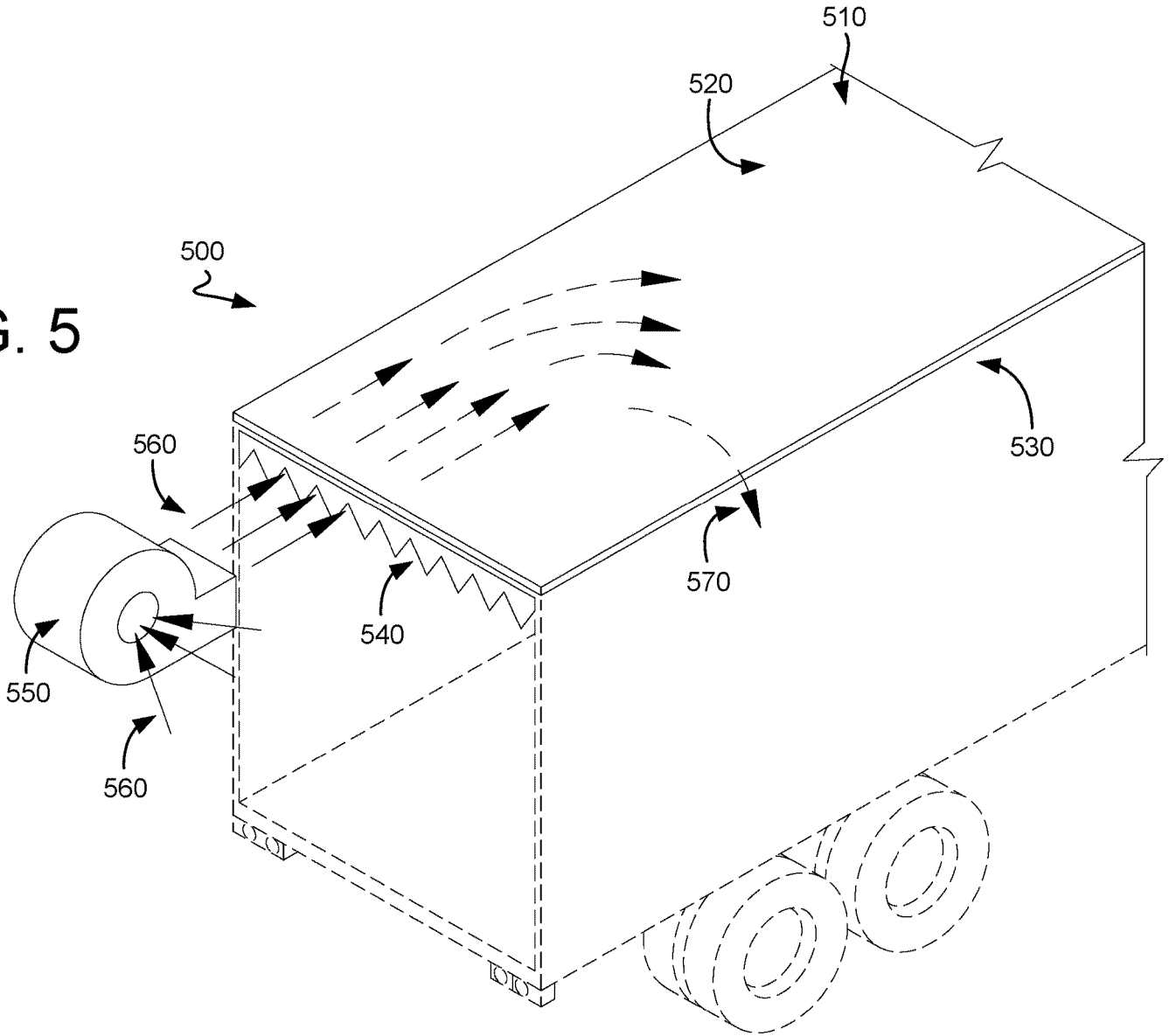
FIG. 5 depicts a third example heat-dissipating system for supporting the operation of embodiments described herein.

Referring now to FIG. 5, a diagram of a third example heat-dissipating system 500 suitable for use in implementing embodiments of the disclosure is shown. As shown in FIG. 5, the heat-dissipating system 500 includes a sheet 510 with a top face 520 and a bottom face 530. As previously discussed, the heat-dissipating system 500 may be configured for integration into an object. For example, as shown in FIG. 5, the sheet 510 of the heat-dissipating system 500 may serve as a component of the object such as a roof of a trailer for a semi-truck.

Similar to the sheet 410 of the second example heat-dissipating system 400 shown in FIG. 4, the sheet 510 for this particular system 500 may be one continuous body to serve as the component of the object or may be combined with other sheets 510 and/or other structures to serve as the component of the object. For example, the sheet 510 may be one continuous body that serves as the roof to the trailer. In another example, the sheet 510 may be combined with other sheets 510 and/or other structures, such as panels, to form the roof of the trailer.

The sheet 510 can be made out of different materials such as copper, aluminum, copper brass, aluminum bronze, iron, thermally conductive plastic, and/or the like. In particular embodiments, the sheet 510 may be composed of materials that have a higher thermal conductivity to allow for better heat dissipation while in operation. However, in other embodiments, the sheet 510 may be composed of any material that is capable of providing and forming a barrier for integration with an object (e.g., vehicle, facility, etc.).

As shown in FIG. 5, the sheet 510 is in a rectangular panel formation. However, alternatively, the sheet 510 may take the shape of other panel formations (e.g., square, triangular, etc.). In instances where the sheet 510 is serving as a roof of an object, or portion thereof, the top face 520 is the exterior of the sheet 510 that faces the elements, and the bottom face 530 is the interior of the sheet 510 that is directly exposed to an interior space of the object. In addition, the top face 520 of the sheet 510 may provide a surface area for applying a radiative cooling material.

In some embodiments, the bottom face 530 of the sheet 510 includes a heat transfer element 540. Similar to the other heat transfer elements 148, 440 discussed herein, the heat transfer element 540 may have some type of geometry that provides beneficial properties, such as exposed surface area, turbulence generation, and/or the like, to increase the rate of heat transfer to or from the environment. As an illustrative example, the heat transfer element 540 may be implemented as fins extending from the bottom face 530 of the sheet 510 such as a folded-fin style or bonded-fin style heat exchanging geometry. As another illustrative example, the heat transfer element 540 may be implemented as corrugations such as a geometry composed of rows of linear ridges and/or groves extending from the bottom face 530 of the sheet 510. Yet, as another illustrative example, the heat transfer element 540 may be implemented as some type of gyroid pattern, open-cell metal foam, and/or the like extending from the bottom face 530 of the sheet 510 and covering at least a portion of the surface area of the bottom face 530.

The heat-dissipating system 500 shown in FIG. 5 includes a powered component 550 that is located outside the interior space of the trailer to draw in airflow 560 externally sourced from the interior space and blow (e.g., force) the airflow 560 over the heat transfer element 540 through an open end of the trailer. Accordingly, the configuration of the heat transfer element 540 may be provided so as to facilitate the airflow 560 over the heat transfer element 440 and/or to facilitate the channeling of the airflow 560 into the interior space. For example, the powered component 550 may be a blower fan and the heat transfer element 540 may be provided as rows of linear fins or corrugations that run the length of the trailer so as to facilitate efficient airflow 560 over the heat transfer element 540 and into the interior space. For example, the powered component 550 may provide an airflow that is parallel to one of the axis of the sheet 510. Such a configuration can provide the advantage of taking an airflow outside of the interior space, cooling the airflow, and ejecting the cooled airflow into the interior space.

In some embodiments, the sheet 510 and the heat transfer element 540 are one piece. For example, the sheet 510 may be formed through stamping, extrusion, forging, injection molding, or cut such that the entire sheet 510 and the heat transfer element 540 are formed from the same piece of material. In other embodiments, the heat transfer element 540 is formed separately from the sheet 510, and the two are later conjoined. For example, the heat transfer element 540 may be mounted to the bottom face 530 of the sheet 510.

Accordingly, as the powered component 550 forces airflow 460 over the heat transfer element 540, the heat transfer element 540 serves to diffuse heat laterally across the sheet 510 and away from hot spots (e.g., vehicle, facility, etc.). The cooled air 570 may then circulate within the interior space of the trailer. The heat transfer element 540 may be formed from any suitable thermally conductive material, such as copper, aluminum, or thermally conductive plastic. In some embodiments, the heat transfer element 540 may include one or more heat pipes and/or vapor chambers configured to transfer heat laterally via evaporative cooling.

In some embodiments, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some embodiments, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C."

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated.

The following embodiments 1-20 summarize certain aspects of the invention described in this specification. They are not the claims in the sense of 35 U.S.C. § 112:

Embodiment 1: A heat-dissipating panel comprising: a front opening; a rear opening; a top face comprising a radiative cooling material and a bottom side; a heat transfer element coupled to the bottom side; a bottom face comprising a top side; at least one airflow opening disposed along the top side; a first edge comprising a first front edge, a first interlocking edge, and a first rear edge, wherein the first front edge is adjacent to the top face, the first rear edge is adjacent to the bottom face, and the first interlocking edge extends outward from an interior space of the heat-dissipating panel beyond at least one of the first front edge or the first rear edge; and a second edge comprising a second front edge, a second interlocking edge, and a second rear edge, wherein the second front edge is adjacent to the top face, the second rear edge is adjacent to the bottom face, and the second interlocking edge extends inward into the interior space of the heat-dissipating panel beyond at least one of the second front edge or the second rear edge.

Embodiment 2: The heat-dissipating panel of embodiment 1, wherein the at least one airflow opening comprises at least two airflow openings and the at least two airflow openings differ in size such that an airflow rate is equalized across the heat-dissipating panel.

Embodiment 3: The heat-dissipating panel of embodiment 1 or 2, wherein the heat transfer element is configured as fins extending from the bottom side of the top face.

Embodiment 4: The heat-dissipating panel of embodiment 1 or 2, wherein the heat transfer element is configured as corrugations extending from the bottom side of the top face.

Embodiment 5: The heat-dissipating panel of embodiment 1 or 2, wherein the heat transfer element is configured as at least one of a gyroid pattern or an open-cell metal foam.

Embodiment 6: The heat-dissipating panel of any of embodiments 1 to 5, further comprising: interior side walls adjacent to the bottom side of the top face and the top side of the bottom face; and a divider running a length of the interior side walls to create an upper compartment and a lower compartment within the interior space of the heat-dissipating panel.

Embodiment 7: The heat-dissipating panel of embodiment 6, wherein the interior side walls comprise tracks and the divider is inserted into the tracks to create the upper compartment and the lower compartment.

Embodiment 8: The heat-dissipating panel of embodiment 6, further comprising a duct placed at the rear opening to connect the upper compartment to the lower compartment to facilitate fluid flow from the upper compartment into the lower compartment.

Embodiment 9: The heat-dissipating panel of any of embodiments 1 to 8, wherein the first interlocking edge is interlocked with a second interlocking edge of a second heat-dissipating panel and the second interlocking edge is interlocked with a first interlocking edge of a third heat-dissipating panel to form a radiative cooling system that is coupled to an object.

Embodiment 10: The heat-dissipating panel of embodiment 9, wherein the object is a vehicle and the radiative cooling system is coupled to a roofing of the vehicle and oriented such that the front opening of the heat-dissipating panel is disposed along a primary axis of motion of the vehicle.

Embodiment 11: The heat-dissipating panel of embodiment 9, wherein an air transfer system is coupled to the object to transfer air from an interior space of the object and forced through the front opening.

Embodiment 12: A method of installing a heat-dissipating system for an object, the heat-dissipating system comprising a plurality of heat-dissipating panels, wherein each of the heat-dissipating panels of the plurality of heat-dissipating panels comprises a front opening, a rear opening, a top face comprising a bottom side, a heat transfer element coupled to the bottom side, a bottom face comprising a top side, at least one airflow opening disposed along the top side, a first edge comprising a first front edge, a first interlocking edge, and a first rear edge, wherein the first front edge is adjacent to the top face, the first rear edge is adjacent to the bottom face, and the first interlocking edge extends outward from an interior space of the heat-dissipating panel beyond at least one of the first front edge or the first rear edge, and a second edge comprising a second front edge, a second interlocking edge, and a second rear edge, wherein the second front edge is adjacent to the top face, the second rear edge is adjacent to the bottom face, and the second interlocking edge extends inward into the interior space of the heat-dissipating panel beyond at least one of the second front edge or the second rear edge, the method comprising: assembling an arrangement of the plurality of heat-dissipating panels to cover a surface area of the object, wherein assembling the arrangement of the plurality of heat-dissipating panels involves generating rows of heat-dissipating panels by interlocking a succeeding row of the rows with a preceding row of the rows by coupling the first edge of each heat-dissipating panel of the succeeding row with the second edge of a heat-dissipating panel of the preceding row; and applying a radiative cooling material to a top surface of each of the plurality of heat-dissipating panels.

Embodiment 13: The method of embodiment 12, further comprising attaching an air transfer system to a front edge of the arrangement to enable producing an airflow that can pass through the front opening of each of the heat-dissipating panels from the plurality of heat-dissipating panels that are disposed along the front edge of the arrangement.

Embodiment 14: The method of embodiment 12 or 13, further comprising coupling a duct to the rear opening of each of the heat-dissipating panels from the plurality of heat-dissipating panels that are disposed along a rear edge of the arrangement.

Embodiment 15: The method of embodiment 12 or 13, further comprising coupling a duct to the rear opening of each of the heat-dissipating panels from the plurality of heat-dissipating panels that are disposed along a rear edge of the arrangement and to an inlet into an interior space of the object.

Embodiment 16: A heat-dissipating system comprising: a sheet coupled to an object, the sheet comprising: a top face exposed to an environment and comprising a radiative cooling material, a bottom face exposed to an interior space of the object, and a heat transfer element coupled to the bottom face; and a powered component configured to cause a flow of air over the heat transfer element to transfer heat from the air, through the sheet, and into the environment to cool the air, wherein the heat transfer element comprises a configuration to facilitate the flow of the air into the interior space of the object.

Embodiment 17: The heat-dissipating system of embodiment 16, wherein the heat transfer element comprises a geometry that provides a beneficial property to increase a rate of heat transfer to the environment.

Embodiment 18: The heat-dissipating system of embodiment 16 or 17, wherein the powered component comprises a circulating fan and the configuration of the heat transfer element comprises rows of at least one of radial fins or radial corrugations.

Embodiment 19: The heat-dissipating system of embodiment 16 or 17, wherein the powered component comprises a blower fan and the configuration of the heat transfer element comprises rows of at least one of linear fins or linear corrugations.

Embodiment 20: The heat-dissipating system of embodiment 16 or 17, wherein the heat transfer element comprises at least one of a gyroid pattern or an open-cell metal foam.

What is claimed is:

1. A heat-dissipating panel comprising:

a front opening;

a rear opening;

a top face comprising a radiative cooling material and a bottom side;

a heat transfer element coupled to the bottom side;

a bottom face comprising a top side;

at least one airflow opening disposed along the top side;

a first edge comprising a first front edge, a first interlocking edge, and a first rear edge, wherein the first front edge is adjacent to the top face, the first rear edge is adjacent to the bottom face, and the first interlocking edge extends outward from an interior space of the heat-dissipating panel beyond at least one of the first front edge or the first rear edge; and a second edge comprising a second front edge, a second interlocking edge, and a second rear edge, wherein the second front edge is adjacent to the top face, the second rear edge is adjacent to the bottom face, and the second interlocking edge extends inward into the interior space of the heat-dissipating panel beyond at least one of the second front edge or the second rear edge.

2. The heat-dissipating panel of claim 1, wherein the at least one airflow opening comprises at least two airflow openings and the at least two airflow openings differ in size such that an airflow rate is equalized across the heat-dissipating panel.

3. The heat-dissipating panel of claim 1, wherein the heat transfer element is configured as fins extending from the bottom side of the top face.

4. The heat-dissipating panel of claim 1, wherein the heat transfer element is configured as corrugations extending from the bottom side of the top face.

5. The heat-dissipating panel of claim 1, wherein the heat transfer element is configured as at least one of a gyroid pattern or an open-cell metal foam.

6. The heat-dissipating panel of claim 1, further comprising:

interior side walls adjacent to the bottom side of the top face and the top side of the bottom face; and a divider running a length of the interior side walls to create an upper compartment and a lower compartment within the interior space of the heat-dissipating panel.

7. The heat-dissipating panel of claim 6, wherein the interior side walls comprise tracks and the divider is inserted into the tracks to create the upper compartment and the lower compartment.

8. The heat-dissipating panel of claim 6, further comprising a duct placed at the rear opening to connect the upper compartment to the lower compartment to facilitate fluid flow from the upper compartment into the lower compartment.

9. The heat-dissipating panel of claim 1, wherein the first interlocking edge is interlocked with a second interlocking edge of a second heat-dissipating panel and the second interlocking edge is interlocked with a first interlocking edge of a third heat-dissipating panel to form a radiative cooling system that is coupled to an object.

10. The heat-dissipating panel of claim 9, wherein the object is a vehicle and the radiative cooling system is coupled to a roofing of the vehicle and oriented such that the front opening of the heat-dissipating panel is disposed along a primary axis of motion of the vehicle.

11. The heat-dissipating panel of claim 9, wherein an air transfer system is coupled to the object to transfer air from an interior space of the object and forced through the front opening.

12. A method of installing a heat-dissipating system for an object, the heat-dissipating system comprising a plurality of heat-dissipating panels, wherein each of the plurality of heat-dissipating panels comprises a front opening, a rear opening, a top face comprising a bottom side, a heat transfer element coupled to the bottom side, a bottom face comprising a top side, at least one airflow opening disposed along the top side, a first edge comprising a first front edge, a first interlocking edge, and a first rear edge, wherein the first front edge is adjacent to the top face, the first rear edge is adjacent to the bottom face, and the first interlocking edge extends outward from an interior space of the corresponding heat-dissipating panel beyond at least one of the first front edge or the first rear edge, and a second edge comprising a second front edge, a second interlocking edge, and a second rear edge, wherein the second front edge is adjacent to the top face, the second rear edge is adjacent to the bottom face, and the second interlocking edge extends inward into the interior space of the corresponding heat-dissipating panel beyond at least one of the second front edge or the second rear edge, the method comprising:

assembling an arrangement of the plurality of heat-dissipating panels to cover a surface area of the object, wherein assembling the arrangement of the plurality of heat-dissipating panels involves generating rows of heat-dissipating panels by interlocking a succeeding row of the rows with a preceding row of the rows by coupling the first edge of each heat-dissipating panel of the succeeding row with the second edge of a heat-dissipating panel of the preceding row; and applying a radiative cooling material to a top surface of each of the plurality of heat-dissipating panels.

13. The method of claim 12, further comprising attaching an air transfer system to a front edge of the arrangement to enable producing an airflow that can pass through the front opening of each of the heat-dissipating panels from the plurality of heat-dissipating panels that are disposed along the front edge of the arrangement.

14. The method of claim 12, further comprising coupling a duct to the rear opening of each of the heat-dissipating panels from the plurality of heat-dissipating panels that are disposed along a rear edge of the arrangement.

15. The method of claim 12, further comprising coupling a duct to the rear opening of each of the heat-dissipating panels from the plurality of heat-dissipating panels that are disposed along a rear edge of the arrangement and to an inlet into an interior space of the object.

16. The heat-dissipating panel of claim 1, wherein the first interlocking edge comprises a cylindrical configuration that extends outward from the interior space of the heat-dissipating panel.

17. The heat-dissipating panel of claim 1, wherein the second interlocking edge comprises a cylindrical configuration that extends inward into the interior space of the heat-dissipating panel.

18. The heat-dissipating panel of claim 10, further comprising a plurality of airflow openings disposed along the top side of the bottom face to facilitate ejecting air passing through the front opening into an interior of the vehicle while the vehicle is in motion.

19. The heat-dissipating panel of claim 18, wherein at least some of the plurality of airflow openings differ in sizes and are disposed along a length of the top side of the bottom face.

20. The heat-dissipating panel of claim 18, wherein each of the plurality of airflow openings is aligned with an opening on the roofing of the vehicle to allow for the air to be ejected into the interior of the vehicle.

* * * * *